US005543691A

United States Patent [19]

Palevsky et al.

[11] Patent Number: 5,543,691

[45] Date of Patent: Aug. 6, 1996

[54] FIELD EMISSION DISPLAY WITH FOCUS GRID AND METHOD OF OPERATING SAME

[75] Inventors: Alan Palevsky, Wayland; Peter F. Koufopoulos, Millis, both of Mass.

[73] Assignee: Raytheon Company, Lexington, Mass.

[21] Appl. No.: 439,391

[22] Filed: May 11, 1995

[51] Int. Cl.[6] ..... H01J 29/70; H01J 29/72

[52] U.S. Cl. ..... 315/366; 313/309

[58] Field of Search ..... 315/366, 169.3, 315/169.4; 313/309, 351

[56] References Cited

U.S. PATENT DOCUMENTS

| | | | |
|---|---|---|---|
| 4,513,308 | 4/1985 | Greene et al. | 357/55 |
| 4,663,559 | 5/1987 | Christensen | 313/336 |
| 4,695,773 | 9/1987 | Veneklasen et al. | 315/382 |
| 4,740,705 | 4/1988 | Crewe | 250/423 F |
| 4,857,161 | 8/1989 | Borel et al. | 204/192.26 |
| 4,908,539 | 3/1990 | Meyer | 315/169.3 |
| 4,940,916 | 7/1990 | Borel et al. | 313/306 |
| 5,012,153 | 4/1991 | Atkinson et al. | 313/351 |
| 5,012,482 | 4/1991 | Gray | 372/74 |
| 5,030,895 | 7/1991 | Gray | 315/350 |
| 5,032,832 | 7/1991 | Clerc et al. | 340/805 |
| 5,045,754 | 9/1991 | Clerc | 313/495 |
| 5,057,047 | 10/1991 | Greene et al. | 445/24 |
| 5,064,396 | 11/1991 | Spindt | 445/50 |
| 5,075,683 | 12/1991 | Ghis | 340/793 |
| 5,103,144 | 4/1992 | Dunham | 315/366 |
| 5,103,145 | 4/1992 | Doran | 313/309 |
| 5,138,308 | 8/1992 | Clerc et al. | 340/758 |
| 5,155,412 | 10/1992 | Chang et al. | 315/14 |
| 5,191,217 | 3/1993 | Kane et al. | 250/423 |
| 5,194,780 | 3/1993 | Meyer | 315/169.3 |
| 5,214,345 | 3/1993 | Gray | 313/355 |
| 5,225,820 | 7/1993 | Clerc | 340/752 |
| 5,231,387 | 7/1993 | Clerc | 340/781 |
| 5,231,606 | 7/1993 | Gray | 365/226.6 |
| 5,262,698 | 11/1993 | Dunham | 315/169.4 |
| 5,278,544 | 1/1994 | Leroux | 345/74 |
| 5,347,292 | 9/1994 | Ge et al. | 345/74 |
| 5,359,256 | 10/1994 | Gray | 313/169 |

OTHER PUBLICATIONS

Field Emission Displays—A 10,000 fL High–Efficiency Field Emission Display by Alan Palevsky, Gordon Gammie and P. Koufopoulos Society for Information Displays, San Hose, CA, 12–17 Jun. 1994.

*Primary Examiner*—Theodore M. Blum
*Attorney, Agent, or Firm*—Donald F. Mofford

[57] ABSTRACT

A field emission display having a plurality of pixels is disclosed wherein each pixel includes a cathode with a plurality of field emitters and corresponding gate electrodes to emit electrons, an anode distally disposed with respect to the cathode, the anode and the cathode capable of having a voltage difference greater than 6000 volts, and a focus grid disposed between the anode and the cathode, the focus grid having an aperture and disposed in proximity with the cathode to focus electrons from the plurality of field emitters of the cathode toward the anode. With such an arrangement, a field emission display is provided having greater brightness and efficiency.

19 Claims, 6 Drawing Sheets

FIELD EMISSION DISPLAY WITH FOCUS GRID AND METHOD OF OPERATING SAME

BACKGROUND OF THE INVENTION

This invention relates to field emission displays and more particularly to a technique for improving brightness and efficiency of field emission displays.

As it is known in the art, typically a conventional field emission display (FED) uses a triode structure with small cathode to anode spacing. The emitter and gate are integral to the matrix addressable field emission cathode and the anode is placed approximately 0.2 mm away. This spacing is maintained by small spacers placed between the cathode and anode. The problem with this structure is the small spacing limits the anode voltage to typically under 1000 volts which in turn limits brightness and efficiency. To operate at increased voltage, the cathode to anode spacing must be increased. However, the angular distribution of the electrons that are emitted from the cathode have a half angle of over thirty degrees such that as the spacing is increased, the electron beam from the pixels spread out with a loss of video resolution on the phosphor anode. The high voltage tends to curve the electron trajectories into lines more perpendicular to the anode surface but the latter is not enough to overcome the initial high angular spread. Another problem with a high voltage anode is that any positive ions created at the anode will be accelerated back to the cathode and cause damage.

SUMMARY OF THE INVENTION

In accordance with the present invention, a field emission display having a plurality of pixels includes each pixel having a cathode with a plurality of field emitters and corresponding gate electrodes to emit electrons, an anode distally disposed with respect to the cathode, the anode and the cathode capable of having a voltage difference greater than 6000 volts, and a focus grid disposed between the anode and the cathode, the focus grid having an aperture and disposed in proximity with the cathode to focus electrons from the plurality of field emitters of the cathode toward the anode. With such an arrangement, a field emission display is provided having greater brightness and efficiency.

In accordance with another aspect of the present invention, the field emission display having a plurality of pixels includes each pixel having a second focus grid disposed between the anode and a first focus grid, the second focus grid having an aperture coaxial with the aperture of the first focus grid and disposed in proximity with the first focus grid to focus electrons from the plurality of field emitters of the cathode toward the anode. With such an arrangement, control of the electrons from the field emitters to the anode is increased and any secondary electrons generated at the first focus grid may be suppressed.

In accordance with still another aspect of the present invention, the field emission display includes offsetting the aperture of the focus grid or focus grids from the cathode. With such an arrangement, a field emission display is provided with a cathode having greater life expectancy due to reduced back ion bombardment of the cathode. With the aperture of the focus grid offset from the cathode in a direction perpendicular to the electron trajectory, electrons will be imaged to a point on the anode that is not in line with the aperture of the focus grid. Any ions that are emitted from the anode will be intercepted by the focus grid and prevented from reaching the cathode. The focus grid only focuses the electrons and not the ions.

BRIEF DESCRIPTION OF THE DRAWINGS

For a more complete understanding of this invention, reference is now made to the following description of the accompanying drawings, wherein.

DESCRIPTION OF THE PREFERRED EMBODIMENTS

Figure 1:
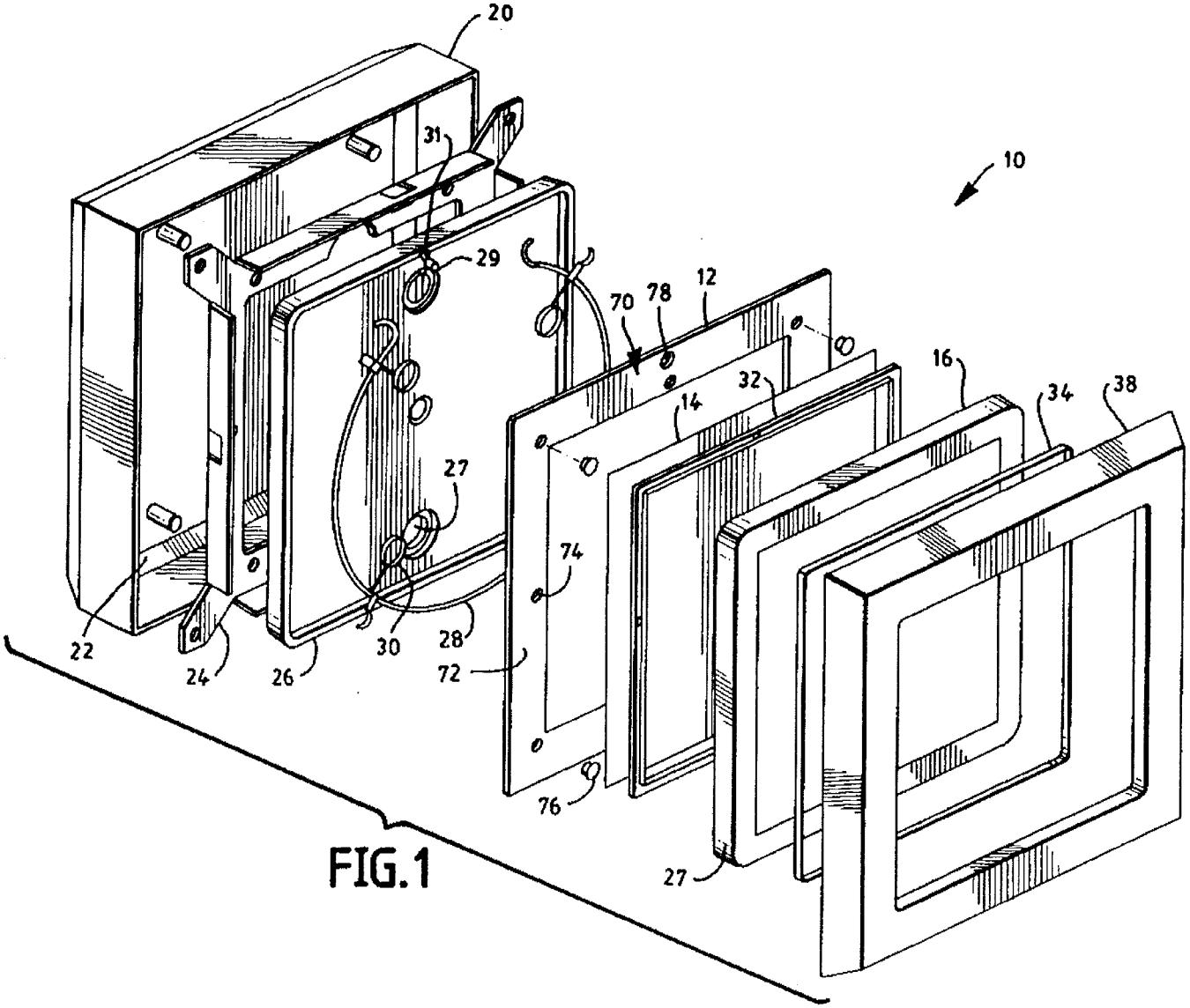
FIG. 1 is an exploded isometric view of a field emission display according to the invention.
Figure 2:
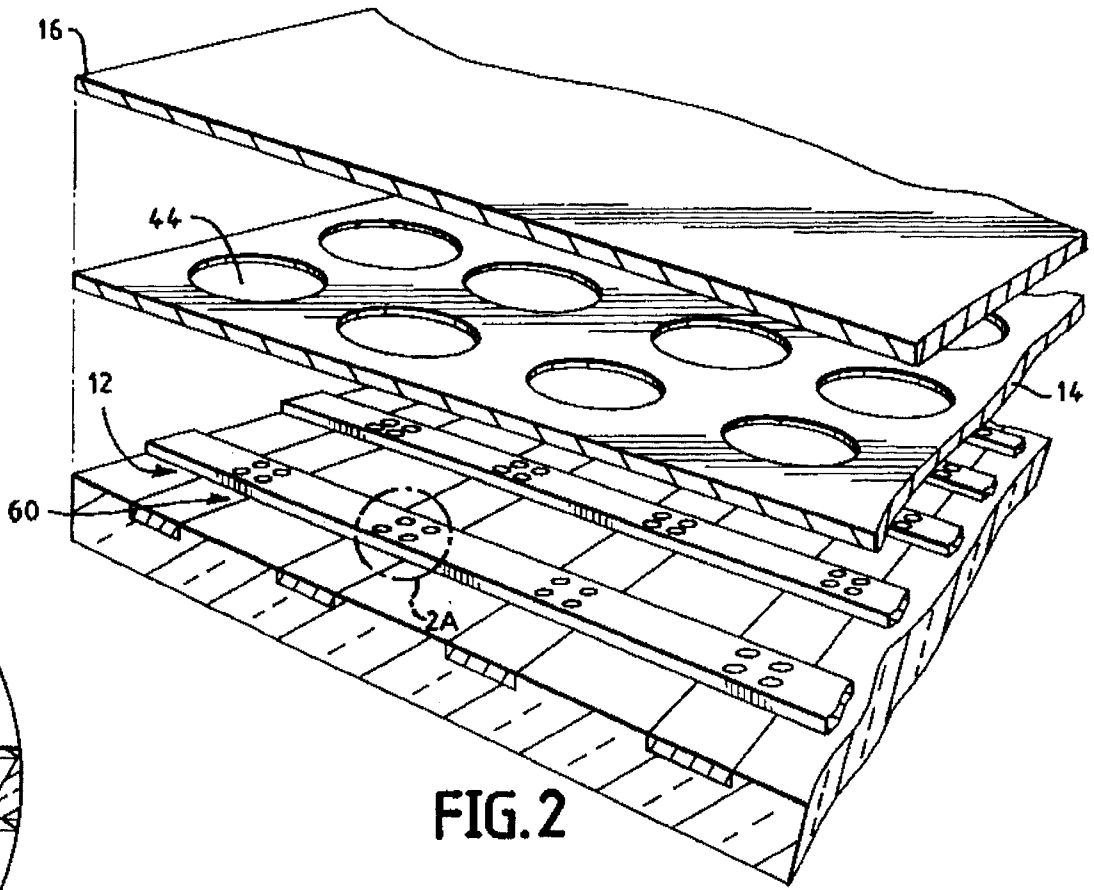
FIGS. 2 and 2A are diagrammatic views of a field emission display according to the invention.
Figure 2A:
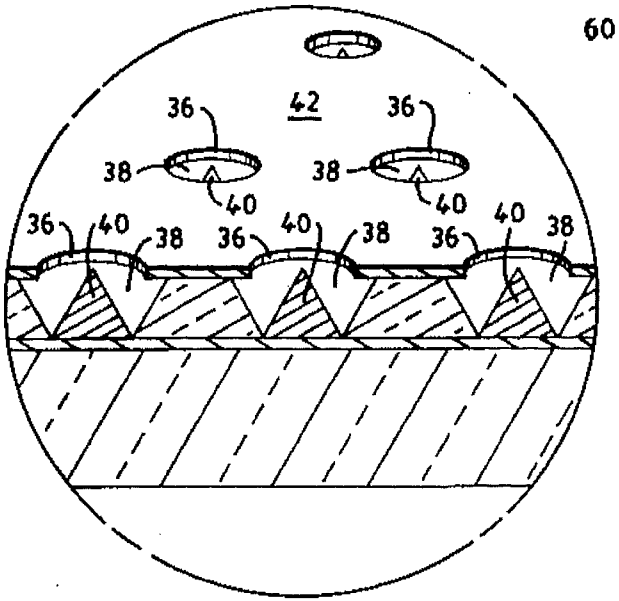
Figure 3:
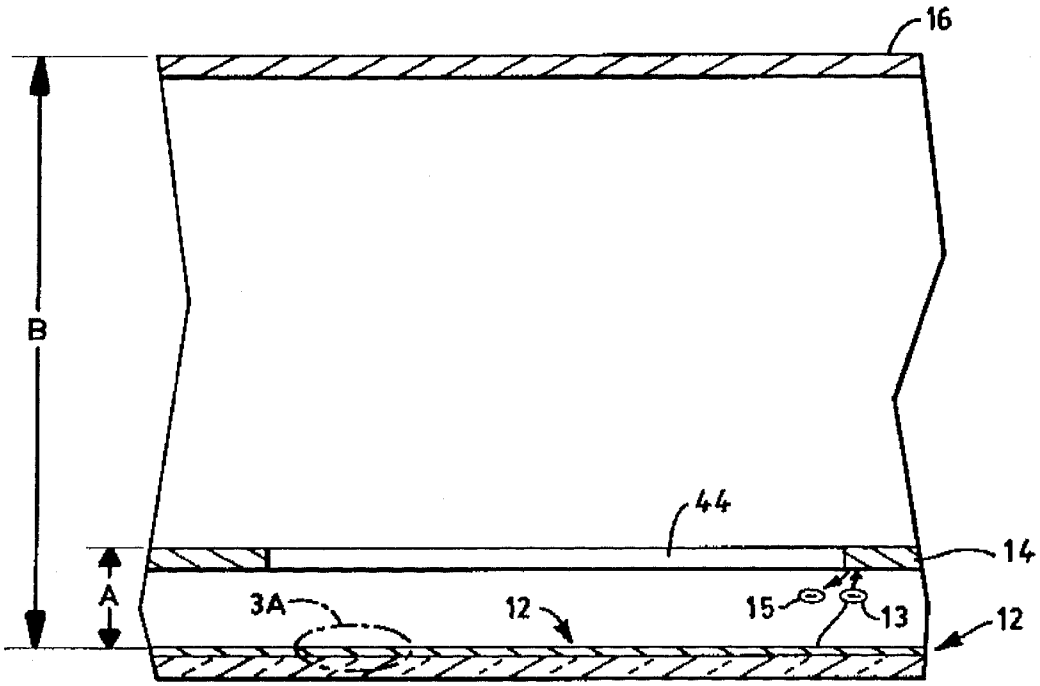
FIGS. 3 and 3A are cross-sectional views of a field emission display according to the invention.
Figure 3A:
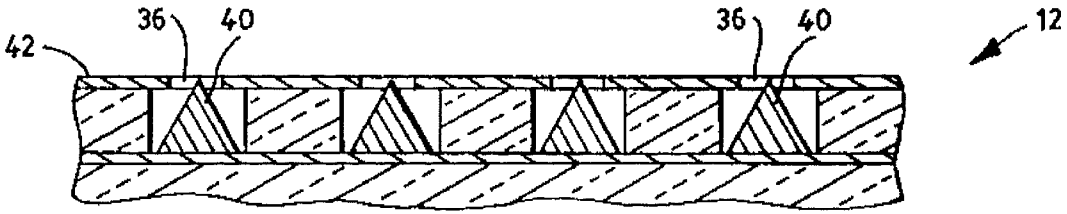

Referring to FIGS. 1, 2 AND 2A, it may be seen that a field emission display (FED) 10 according to the present invention includes a plurality of pixels 60 with each pixel 60 having a field emission cathode 12 with an integral field emitter 40 and gate electrode 42, a focus grid 14 and an anode 16 coated with phosphor. The latter is a tetrode structure. Known FEDs typically have a voltage differential of 500 volts or less between the cathode and the anode. Here, the voltage differential can be as high as 10 kilovolts between the cathode 12 and the anode 16 providing a brightness of 10,000 fL at a luminous efficiency of 48 lumens per watt. It should be appreciated that the field emission cathode 12 has a matrix addressable set of pixels with each pixel including many field emitters 40, here typically 400. The field emitters 40 are molybdenum microtips on soda-lime glass. Here, an array of pixels 60 have a 300 micron pitch (i.e. center spacing) between adjacent pixels. Each pixel 60 includes a 25×25 micron subarray which includes a 4×4 array of field emitters 40 with a 5×5 array of subarrays to complete a pixel 60. Thus, a pixel 60 occupies an area of 125×125 microns with 400 field emitters 40 included in a pixel 60. The pixels are connected in a passive matrix configuration with the field emitters 40 connected in columns and the gate electrodes 42 connected in rows with the rows and columns leading to the edges. Alternatively, alternate rows and columns can lead to opposite edges.

The cathode 12 is fabricated according to the teachings of U.S. Pat. No. 4,908,539 entitled "Display Unit by Cathodoluminescence Excited by Field Emission" issued Mar. 13, 1990 and U.S. Pat. No. 4,940,916 entitled "Electron Source with Micropoint Emissive Cathodes and Display Means by Cathodoluminescence Excited by Field Emission Using Said Source" issued Jul. 10, 1990 and are incorporated herein by reference. Suffice it say here, each one of the field emitters 40 within a pixel 60 is fed an emitter voltage, here typically −90 volts and each one of the gate electrodes within a pixel 60 is fed a gate voltage, here typically zero volts. Each pixel 60 includes a 5×5 array of subarrays with a subarray of 4×4 field emitters 40 providing a total of 400 field emitters per pixel. It should be appreciated that other arrangements are also possible. For example, a 6×4 array of subarrays with a subarray of 4×4 field emitters 40 providing a total of 384 field emitters per pixel could be used.

Figure 6:
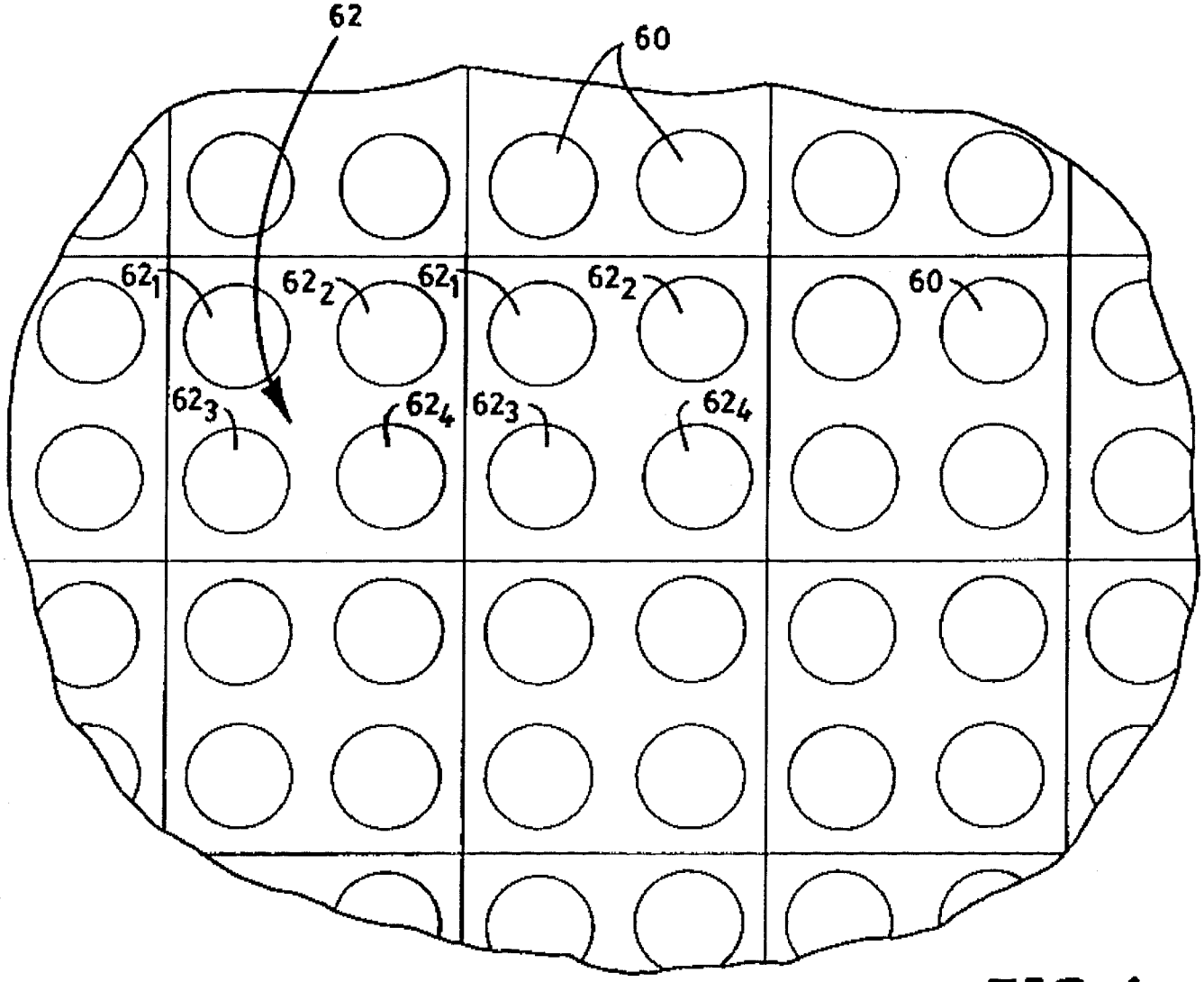
FIG. 6 is a sketch of the arrangement of colorization of the phosphor for a color field emission display.

The anode 16 includes a phosphor to provide an image when the phosphor is excited. In a monochrome system, each pixel 60 is a pixel for the purpose of determining resolution of the picture. In a color system, one color pixel includes four pixels the size of the monochrome system. Referring to FIG. 6, a plurality of pixels 60 are shown. In a monochrome system, the phosphor corresponding with each pixel 60 would be the desired color or white. In a color system, a quad arrangement with red, green and blue phosphor is used to provide a color image. Thus, in a color system, each color pixel 62 includes four pixels $\mathbf{62}_1$, $\mathbf{62}_2$, $\mathbf{62}_3$ and $\mathbf{62}_4$ wherein pixel $\mathbf{62}_1$ and $\mathbf{62}_4$ includes green phosphor, pixel $\mathbf{62}_2$ includes red phosphor and pixel $\mathbf{62}_3$ includes blue phosphor. Alternatively, each color pixel 62 includes four pixels $\mathbf{62}_1$, $\mathbf{62}_2$, $\mathbf{62}_3$ and $\mathbf{62}_4$ wherein pixel $\mathbf{62}_1$ and $\mathbf{62}_4$ includes blue phosphor, pixel $\mathbf{62}_2$ includes green phosphor and pixel $\mathbf{62}_3$ includes red phosphor. It should be appreciated that other color arrangements may also be used as is known in cathode ray tube color imaging.

The focus grid 14 is an electrode placed between the cathode 12 and the anode 16. The focus grid 14 has an array of apertures 44 that are coaxial with the pixels on the cathode 12 and the anode 16. Here, the apertures 44 have a diameter of 150 microns. The focus grid 14 is biased at a voltage greater than the field emitter 40 of the cathode 12 and less than the anode 16. The focus grid 14 serves three purposes. The focus grid 14 will intercept any very high angle electrons and prevent them from getting to the anode 16. Secondly, the focus grid 14 will focus the electrons that are not intercepted. The focus is adjusted by the voltage fed to the focus grid 14 for optimal video performance which may include having the focal point at a point other than at the anode 16. The focal point may be in front of, at or behind the anode 16 depending upon the voltage. Thirdly, the focus grid 14 isolates the cathode 12 from the high voltage of the anode 16. The electric field in the gap between the cathode 12 and the focus grid 14 is less than the electric field in the gap between the focus grid 14 and the anode 16. The focus grid 14 may be fabricated from metal or a metalized glass, ceramic or graphite.

The display 10 as shown further includes a rear cover 20, a printed circuit board 22, a mounting bracket 24, a glass bottom panel 26, a getter support 28 including a getter device 30, a grid frame 32, a glass top panel 27, an enhancement filter 34 and a top cover 38 as to be described. As described above the cathode 12 is fabricated according to the teachings of U.S. Pat. No. 4,908,539 and U.S. Pat. No. 4,940,916. The cathode 12 includes a glass substrate 70 as shown with the plurality of integral field emitters 40 and gate electrodes 42 disposed on the glass substrate 70. On the front of the glass substrate 70, leads (not shown) are disposed to feed signals to the field emitters 40 and the gate electrodes 42. The cathode 12 includes a glass periphery 72 wherein no field emitters 40 and gate electrodes 42 are disposed. The focus grid 14 is mounted to the grid frame 32. The grid frame 32 is mounted to the glass periphery 72 of the cathode 12 with standoffs 76. The standoffs 76 are fabricated from stainless steel or other material and are connected to the grid frame 32 by welding or any other known technique. The standoffs 76 are inserted into pressure rings 74 which are disposed in the glass periphery 72 as shown. The anode 16 is disposed within the top panel 27. A high voltage pin 29 contacts the anode 16 when assembled to feed a voltage signal to the anode 16 when operating. It should be appreciated the high voltage pin 29 is isolated by an insulator 31 which is inserted in a hole 78 in the cathode 12 to connect the high voltage pin 29 to the anode. A getter support ring 28 is disposed adjacent the bottom panel 26 with a plurality of getters 30 mounted on the getter support ring 28. The getter 30 absorbs residual gas and maintains the required vacuum level over the life of the device as is known. The bottom panel 26 also includes a hole 27 wherein the lead for the focus grid 16 is fed to connect the focus grid 14 to a control signal in a manner as shown for the high voltage pin 29. Alternatively, instead of a pin, a metal ribbon conductor or spring can be used to connect the control signal to the focus grid 14. The above described assembly is assembled and the glass bottom panel 26 is fritted together with the glass top panel 27 as is known. Here, the panels 26, 27 are preglazed and put in a vacuum furnace and heated at a temperature of 450 degrees Fahrenheit to bond the bottom panel 27 to the top panel 27 with the glass periphery 72 in between. It should be noted that the niobium leads (not shown) disposed on the glass substrate 70 will oxidize when exposed to a high temperature, oxygen environment. It is desirable to dispose by sputtering a 4/10ths of a micron layer of silicon oxide ($SiO_2$) over the leads to prevent oxidation during the assembly process and to promote vacuum tight adhesion of the frit to the niobium metal. Once the fritting process is completed the leads can be cleaned and wires can be attached to the leads as needed.

The glass bottom panel 26 is mounted to the mounting bracket 24 by any known means, here using silicon rubber which provides agility and shock resistance. A printed circuit board 22 is attached to an opposing side of the mounting bracket 24. The printed circuit board 22 includes the control circuitry for the field emission display 10. A rear cover 20 is also attached to the mounting bracket 24. An optical contrast enhancement filter 34 is disposed in front of the glass top panel 27. Here, the enhancement filter 34 is a 10:1 enhancement filter although other ratios may be used to provide greater contrast. Completing the assembly, a top cover 38 is attached to the rear cover 20 by any known means.

Figure 4:
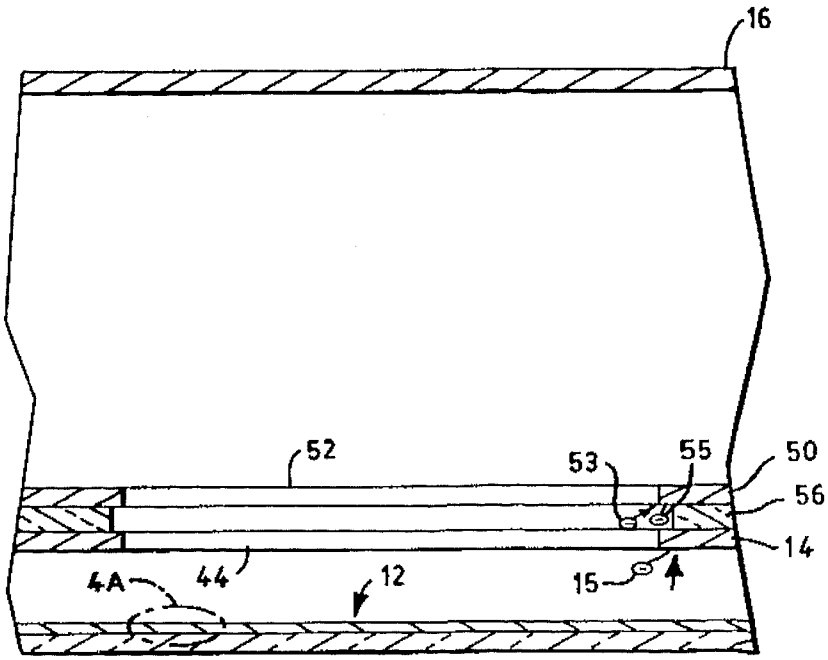
FIGS. 4 and 4A are cross-sectional views of an alternative embodiment of a field emission display according to the invention.

Referring now to FIGS. 2, 2A, 3 and 3A, the focus grid 14 has a large number of electrons 13 impinging on it from the cathode 12. These electrons tend to generate low voltage secondary electrons 15. A percentage of these secondary electrons 15 drift into the focus grid aperture 44 and are then accelerated by the anode 16. There are two techniques to reduce this effect. A first technique is to coat the surface of the focus grid 14 with a material that has a reduced secondary emission coefficient. Such material includes but is not limited to graphite, titanium, and beryllium coatings. Referring momentarily to FIG. 4, a second technique is to place a second focus grid 50 between the focus grid 14 and the anode 16. The cathode 12 including the integral emitter 40 and the gate electrode 42, the focus grid 14, the second focus grid 50, and the anode 16 makes a total of five electrodes or a pentode structure. The second focus grid 50 is biased negative with respect to the first focus grid 14. The low energy secondary electrons 15 from the first focus grid 14 are repelled by the second focus grid 50 while the higher energy electrons from the cathode 12 will have enough energy to pass through to the anode 16. The electrode aperture 44 of the focus grid 14 and the electrode aperture 52 of the second focus grid 50 are co-linear and the electrode aperture 52 may be smaller, the same size, or larger than those of the electrode aperture 44. Secondary electrons 55 generated by any primary electrons 53 hitting the second focus grid 50 will be accelerated back to the focus grid 14 and absorbed. The focus grid 14 will sink current while the second focus grid 50 will source current.

Figure 4A:
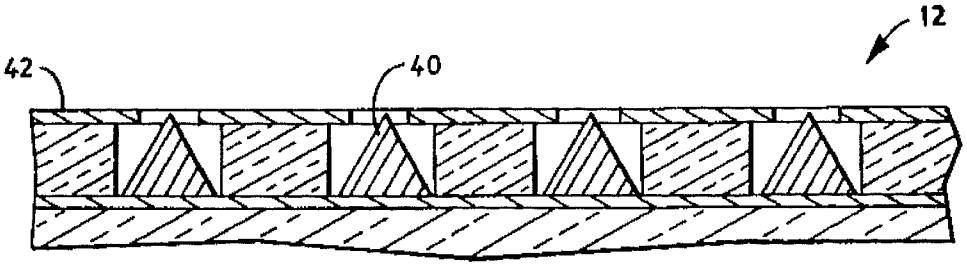

The focus grid 14 and the second focus grid 50 have an optional interlayer dielectric insulator 56 to form an integral multilayered structure. A dielectric insulator is not used between the cathode 12 and the focus grid 14 and the second focus grid 50 and the anode 16. Here, support is only provided along the edges. The apertures in the dielectric insulators 56 are aligned with those of the focus grid 14 and the focus grid 50. The apertures in the dielectric insulators 56 are greater than those in the focus grids 14, 50 to minimize secondary emission from the edges of the dielectric insulator 56. Typical focus grid aperture diameters are from 0.07 to 0.2 mm. Typical spacing from the cathode 12 to the focus grid 14 is from 0.3 to 0.6 mm and spacing from the focus grid 14 to the anode is from 2 to 4 mm for the arrangement shown in FIG. 3. For the pentode configuration as shown in FIGS. 4and 4A, the spacing is as described for FIG. 3 with the spacing between the focus grid 14 and the second focus grid 50 from 0.3 to 0.6 mm. Here, in FIG. 3, the dimension A from the cathode 12 to the focus grid 14 is 0.5 mm and the dimension B from the cathode 12 to the anode 16 is 3.5 mm. Heat generated by the current on the grids is dissipated through the edges. The focus grid 14 (FIG. 3) in the tetrode configuration and the focus grids 14, 50 (FIG. 4) in the pentode configuration will typically have a thickness from 0.1 mm to 1.0 mm (millimeter).

Figure 5:
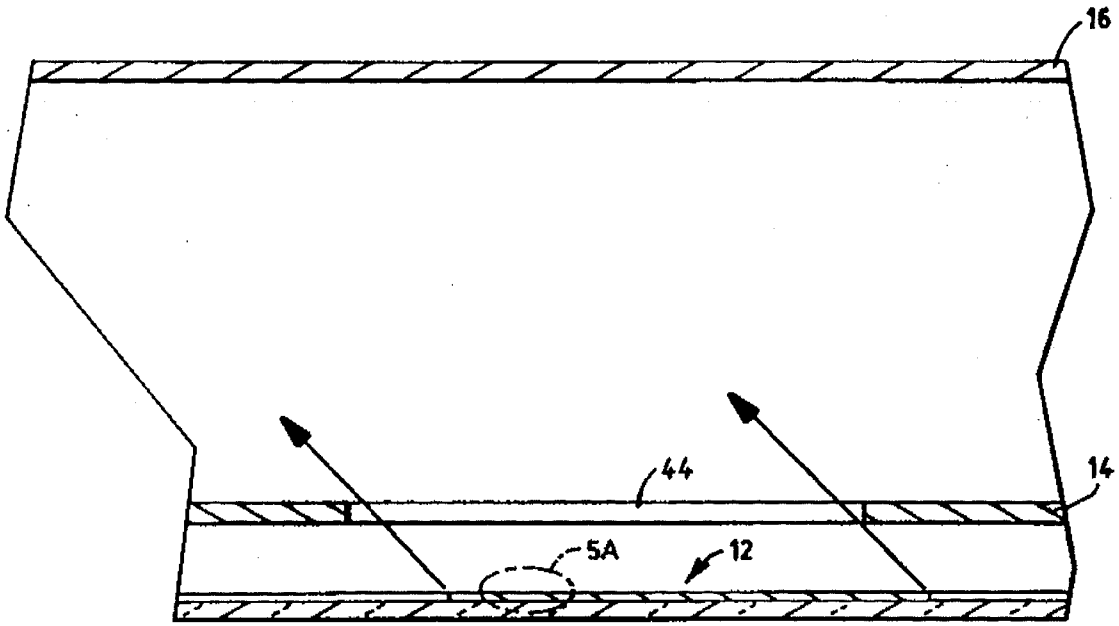
FIGS. 5 and 5A are cross-sectional views of an alternative embodiment of a field emission display with the focus grid offset from the cathode according to the invention.
Figure 5A:
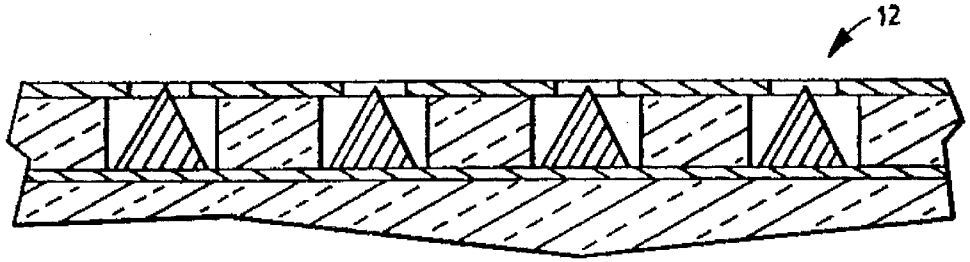

Referring now also to FIGS. 5 and 5A, the apertures 44 in the focus grid 14 may be offset from the pixels of the cathode 12 to reduce back ion bombardment of the cathode 12. When the apertures 44 of the focus grid 14 and the pixels of the cathode 12 are in perfect alignment, the electrons will hit the phosphor anode 16 directly above the cathode 12. Any positive ions that are emitted from the anode 16 will be accelerated by the full anode potential back to the cathode 12 and could reduce the life of the cathode 12. If the focus grid 14 is offset from the cathode 12 in a direction perpendicular to the electron trajectories, the electrons that are do make it through the aperture 44 of the focus grid 14 will be imaged to a point on the phosphor anode 16 that is not in line with the focus grid aperture 44. Since the ion masses are much larger than the electron mass, any ions that are emitted from the anode 16 will now be intercepted by the focus grid 14 and never reach the cathode 12, i.e. the focus grid only focuses electrons, not ions.

It should now be appreciated that a field emission display according to the present invention includes a cathode having an array of pixels, each pixel having a plurality of field emitters and corresponding gate electrodes to emit electrons and an anode distally disposed from 2 to 10 millimeters with respect to the cathode, the anode and the cathode capable of having a voltage difference greater than 2000 volts. The field emission display further includes a focus grid disposed between the anode and the cathode with the focus grid disposed from 100 microns to 1000 microns from the cathode. The focus grid includes an array of apertures, each aperture disposed coaxial with a corresponding pixel of the cathode to focus electrons from the plurality of field emitters of the pixel of the cathode toward the anode. Each pixel of the cathode typically includes at least 100 field emitters. Typically, each aperture in the focus grid has a diameter between 50 microns and 500 microns. An alternative embodiment of the field emission display includes offsetting the aperture of the focus grid from the cathode in a direction perpendicular to electron trajectory such that electrons are imaged to a point on the anode that is not in line with the aperture of the focus grid. Also, a second focus grid can be disposed between the anode and the focus grid, the second focus grid having an array of apertures, each aperture coaxial with a corresponding aperture of the focus grid and disposed in proximity with the focus grid to focus electrons from the plurality of field emitters of the cathode toward the anode. The second focus grid is disposed between 100 microns and 1000 microns from the focus grid and can also be offsetted from the cathode in a direction perpendicular to electron trajectory such that electrons are imaged to a point on the anode that is not in line with the aperture of the focus grid.

Having described this invention, it will now be apparent to one of skill in the art that various modifications could be made thereto without affecting this invention. It is felt, therefore, that this invention should not be restricted to its disclosed embodiment, but rather should be limited only by the spirit and scope of the appended claims.

What is claimed is:

1. A field emission device comprising:

a cathode having an array of pixels, each pixel having a plurality of field emitters and corresponding gate electrodes to emit electrons;

an anode distally disposed with respect to the cathode; and a focus grid disposed between the anode and the cathode, the focus grid having an array of apertures, each aperture disposed coaxial with a corresponding pixel of the cathode to focus electrons from the plurality of field emitters of the pixel of the cathode toward the anode.

2. The field emission device as recited in claim 1 wherein the anode and the cathode is capable of having a voltage difference greater than 2000 volts.

3. The field emission device as recited in claim 1 wherein each pixel of the cathode comprises at least 100 field emitters.

4. The field emission device as recited in claim 1 wherein spacing from the cathode to the focus grid is from 100 to 1000 microns and spacing from the focus grid to the anode is from 2 to 10 millimeters.

5. The field emission device as recited in claim 1 wherein each aperture in the focus grid has a diameter between 50 microns and 500 microns.

6. The field emission device as recited in claim 1 comprising offsetting the aperture of the focus grid from the cathode in a direction perpendicular to electron trajectory such that electrons are imaged to a point on the anode that is not in line with the aperture of the focus grid.

7. The field emission device as recited in claim 1 comprising a second focus grid disposed between the anode and the focus grid, the second focus grid having an aperture coaxial with the aperture of the focus grid and disposed in proximity with the focus grid to focus electrons from the plurality of field emitters of the cathode toward the anode.

8. The field emission device as recited in claim 7 comprising offsetting the aperture of the focus grid and the second focus grid from the cathode in a direction perpendicular to electron trajectory such that electrons are imaged to a point on the anode that is not in line with the apertures of the focus grid and the second focus grid.

9. A field emission display having a plurality of pixels, each one of the plurality of pixels comprising:

a cathode with a plurality of field emitters and corresponding gate electrodes to emit electrons;

an anode distally disposed with respect to the cathode, the anode and the cathode capable of having a voltage difference greater than 2000 volts; and a focus grid disposed between the anode and the cathode, the focus grid having an aperture and disposed in proximity with the cathode to focus electrons from the plurality of field emitters of the cathode toward the anode.

10. The field emission display as recited in claim 9 comprising a second focus grid disposed between the anode and the focus grid, the second focus grid having an aperture coaxial with the aperture of the focus grid and disposed in proximity with the focus grid to focus electrons from the plurality of field emitters of the cathode toward the anode.

11. The field emission display as recited in claim 10 comprising offsetting the apertures of the focus grid and the second focus grid from the cathode in a direction perpendicular to electron trajectory such that electrons are imaged to a point on the anode that is not in line with the aperture of the focus grid.

12. The field emission display as recited in claim 9 comprising offsetting the aperture of the focus grid from the cathode in a direction perpendicular to electron trajectory such that electrons are imaged to a point on the anode that is not in line with the aperture of the focus grid.

13. A field emission display comprising:

a cathode having an array of pixels, each pixel having a plurality of field emitters and corresponding gate electrodes to emit electrons;

an anode distally disposed from 2 to 10 millimeters with respect to the cathode, the anode and the cathode capable of having a voltage difference greater than 2000 volts; and a focus grid disposed between the anode and the cathode with the focus grid disposed from 100 microns to 1000 microns from the cathode, the focus grid having an array of apertures, each aperture disposed coaxial with a corresponding pixel of the cathode to focus electrons from the plurality of field emitters of the pixel of the cathode toward the anode.

14. The field emission display as recited in claim 13 wherein each pixel of the cathode comprises at least 100 field emitters.

15. The field emission display as recited in claim 14 wherein each aperture in the focus grid has a diameter between 50 microns and 500 microns.

16. The field emission display as recited in claim 15 comprising offsetting the aperture of the focus grid from the cathode in a direction perpendicular to electron trajectory such that electrons are imaged to a point on the anode that is not in line with the aperture of the focus grid.

17. The field emission display as recited in claim 15 comprising a second focus grid disposed between the anode and the focus grid, the second focus grid having an array of apertures, each aperture coaxial with the aperture of the focus grid and disposed in proximity with the focus grid to focus electrons from the plurality of field emitters of the cathode toward the anode.

18. The field emission display as recited in claim 17 wherein the second focus grid is disposed between 100 microns and 1000 microns from the focus grid.

19. The field emission display as recited in claim 18 comprising offsetting the apertures of the focus grid and the second focus grid from the cathode in a direction perpendicular to electron trajectory such that electrons are imaged to a point on the anode that is not in line with the aperture of the focus grid.

* * * * *